US011813763B2

(12) United States Patent
Kanakaris et al.

(10) Patent No.: US 11,813,763 B2
(45) Date of Patent: Nov. 14, 2023

(54) RAZOR BLADES

(71) Applicant: BIC VIOLEX SINGLE MEMBER S.A., Anoixi (GR)

(72) Inventors: George Kanakaris, Anoixi (GR); Christos Ampatis, Anoixi (GR)

(73) Assignee: BIC VIOLEX SINGLE MEMBER S.A., Anoixi (GR)

( * ) Notice: Subject to any disclaimer, the term of this patent is extended or adjusted under 35 U.S.C. 154(b) by 0 days.

(21) Appl. No.: 16/952,859

(22) Filed: Nov. 19, 2020

(65) Prior Publication Data

US 2021/0154871 A1 May 27, 2021

(30) Foreign Application Priority Data

Nov. 22, 2019 (EP) ..... 19210843

(51) Int. Cl.
*B26B 21/60* (2006.01)
*B26B 21/56* (2006.01)

(52) U.S. Cl.
CPC ..... *B26B 21/60* (2013.01); *B26B 21/56* (2013.01)

(58) Field of Classification Search
CPC ..... B26B 21/60; B26B 21/56; B26B 21/565; B26B 21/4037; C08J 2203/22; C08J 2203/02–166
(Continued)

(56) References Cited

U.S. PATENT DOCUMENTS 4,012,551 A 3/1977 Bogaty et al.
5,347,716 A 9/1994 Crook
(Continued)

FOREIGN PATENT DOCUMENTS

CA 2633406 A1 * 9/2009 ..... A63B 59/70
EP 1481797 12/2004
(Continued)

OTHER PUBLICATIONS

Extended European Search Report dated May 19, 2020 from priority European Patent Application No. 19210843.9, 5 pages.

*Primary Examiner* — Nhat Chieu Q Do
(74) *Attorney, Agent, or Firm* — Ruggiero, McAllister & McMahon LLC

(57) ABSTRACT

A razor blade including a blade body, an expanded coating structure arranged on a surface of the blade body so as to cover the blade body at least partially, the expanded coating structure including one or more expanded polymer microspheres, at least one of the one or more expanded polymer microspheres including a gas encapsulated within a hollow thermoplastic polymer shell. A process for fabrication of same, including providing a blade body, depositing a liquid suspension, the liquid suspension including expandable polymer microspheres dispersed in a liquid uncured polymer precursor, each expandable polymer microsphere including a gas encapsulated within a hollow thermoplastic polymer shell, on a surface of the blade body to obtain a deposit, and expanding at least a portion of the expandable polymer microspheres in the deposit to obtain an expanded deposit including one or more expanded polymer microspheres arranged on the surface of the blade body, the liquid uncured polymer precursor being configured to remain uncured during expansion of the expandable polymer microspheres. A skincare device including such a razor blade. A process of fabricating same, including attaching such a razor blade to a cartridge.

9 Claims, 5 Drawing Sheets

(58) Field of Classification Search
USPC ..... 30/51
See application file for complete search history.

(56) References Cited

U.S. PATENT DOCUMENTS

| | | | | |
|---|---|---|---|---|
| 5,412,872 | A | 5/1995 | Iderosa | |
| 6,544,351 | B2 | 4/2003 | Wang et al. | |
| 7,202,284 | B1 * | 4/2007 | Limerkens | C08J 9/08 521/173 |
| 9,169,659 | B1 | 10/2015 | Ford et al. | |
| 2002/0142106 | A1 | 10/2002 | Bethune et al. | |
| 2009/0181250 | A1 * | 7/2009 | Zmarsly | C09J 155/02 428/343 |
| 2010/0215947 | A1 * | 8/2010 | Yamanaka | C09J 4/00 428/323 |
| 2011/0281964 | A1 * | 11/2011 | Zmarsly | B29B 7/845 521/60 |
| 2016/0297087 | A1 * | 10/2016 | Nicholas | B26B 21/443 |
| 2018/0001492 | A1 | 1/2018 | Nicholas | |
| 2018/0001497 | A1 | 1/2018 | Fontecchio et al. | |
| 2019/0233664 | A1 * | 8/2019 | Killey | C09D 7/61 |

FOREIGN PATENT DOCUMENTS

| | | | | |
|---|---|---|---|---|
| GB | 2540588 A * | 1/2017 | | B05D 1/28 |
| WO | 2005/018884 | 3/2005 | | |
| WO | 2018/089722 | 5/2018 | | |

* cited by examiner

RAZOR BLADES

RELATED APPLICATION

This application claims benefit from European patent application EP19210843.9 filed on Nov. 22, 2019, its content being incorporated herein by reference.

FIELD

The present disclosure relates to the field of shaving and in particular to razor blades.

BACKGROUND ART

It is known from United States Patent Application no US20160297087A1 to print an object onto a blade body of a razor blade, and from United States Patent Application no US20180001497A1 to print a lubricious material on a blade body of a razor blade. However, printing large amounts of material onto a blade may be quite time-consuming and/or expensive and/or cumbersome.

SUMMARY

According to an embodiment of the present disclosure, a razor blade is provided. The razor blade includes a blade body and an expanded coating structure. The expanded coating structure is arranged on a surface of the blade body so as to cover the blade body at least partially. The expanded coating structure includes one or more expanded polymer microspheres. At least one of the one or more expanded polymer microspheres includes a gas encapsulated within a hollow thermoplastic polymer shell.

The blade may thus be provided with one or more protruding structures which are relatively simple and/or rapid and/or inexpensive to produce, for example.

The expanded coating structure may include a cured polymer matrix containing the one or more expanded polymer microspheres.

The expanded coating structure may include equal to or greater than 0.1% and equal to or less than 30% expanded and/or expandable polymer microspheres by mass, specifically equal to or greater than 5% and equal to or less than 15% expanded and/or expandable polymer microspheres by mass, and may include a polymer matrix forming the remainder.

The shell of at least one of the one or more expanded polymer microspheres may have a thickness less than 2 μm (micrometers).

The expanded coating structure may present a maximum thickness, as measured normal to the surface of the blade body, equal to or greater than 120 μm and equal to or less than 500 μm, specifically equal to or greater than 120 μm and equal to or less than 300 μm.

The expanded coating structure may present a width, as measured parallel to the surface of the blade body, equal to or greater than 100 μm and equal to or less than 2000 μm, specifically equal to or greater than 550 μm and equal to or less than 1000 μm.

At least one of the one or more expanded polymer microspheres may have a diameter of equal to or greater than 6 μm and equal to or less than 130 μm.

Additionally or alternatively, a skincare device may be provided according to an embodiment of the present disclosure. The skincare device may include a razor blade as described earlier herein.

Additionally or alternatively, according to an embodiment of the present disclosure, a liquid suspension may be provided for coating a blade body. The liquid suspension may include expandable polymer microspheres dispersed in a liquid uncured polymer precursor. At least one of the expandable microspheres may include a gas encapsulated in a hollow thermoplastic polymer shell. The liquid uncured polymer precursor may be configured to remain uncured during expansion of the expandable polymer microspheres.

The liquid suspension may allow a deposit containing expandable polymer microspheres to be provided on the blade body through liquid deposition techniques, for example.

The liquid suspension may include equal to or greater than 0.1% and equal to or less than 30% expandable polymer microspheres by mass, specifically equal to or greater than 5% and equal to or less than 15% expandable polymer microspheres by mass, and liquid uncured polymer precursor forming the remainder.

At least one of the expandable polymer microspheres may have a diameter equal to or greater than 5 μm and equal to or less than 40 μm, specifically equal to or greater than 6 μm and equal to or less than 40 μm, specifically equal to or greater than 6 μm and equal to or less than 9 μm.

The liquid uncured polymer precursor may be UV-curable.

The liquid uncured polymer precursor may include a UV-curable initiator.

Additionally or alternatively, according to an embodiment of the present disclosure, a process may be provided. The process may be a process for fabrication of a razor blade as described earlier herein. The process may include providing a blade body. The process may include depositing a liquid suspension on a surface of the blade body to obtain a deposit. The liquid suspension may be a liquid suspension as described earlier herein. The process may include expanding one or more of the expandable polymer microspheres in the deposit to obtain an expanded deposit including one or more expanded polymer microspheres arranged on the surface of the blade body.

The process may allow for shaping of the structure(s) on the blade body to be at least partially dissociated from provision of the material from which it is/they are constructed.

The step of expanding one or more of the expandable polymer microspheres may include heating one or more expandable polymer microspheres to a temperature at which the shell is plastically deformable under pressure of the gas encapsulated therein so as to achieve an increase in volume.

The step of expanding one or more of expandable polymer microspheres may include heating the one or more expandable polymer microspheres to a temperature equal to or greater than 80° C. (degree Celsius) and equal to or less than 200° C., specifically equal to or greater than 100° C. and equal to or less than 150° C., specifically equal to or greater than 80° C. and equal to or less than 135° C.

At least one expandable polymer microsphere may undergo an increase in volume that is equal to or less than 200-fold during the step of expanding at one or more of the expandable polymer microspheres, specifically an equal to or less than 38-fold increase in volume during the step of expanding one or more of the expandable polymer microspheres.

The process may comprise curing the liquid uncured polymer precursor subsequent to the step of expanding one or more of the expandable polymer microspheres, to obtain a cured polymer matrix containing one or more expanded polymer microspheres.

The curing step may include exposing the expanded deposit to electromagnetic radiation.

The electromagnetic radiation used in the curing step may have a wavelength of 405 nm (nanometer) or less.

Additionally or alternatively, a process of fabricating a skincare device as described earlier herein may be provided. The process may include attaching a razor blade as described earlier herein to a cartridge.

As used in this disclosure and the appended claims, the term "blade body" may be understood as a blade element including a cutting edge portion and a first flat portion extending from the cutting edge portion.

The blade body may include two cutting edge portions—a configuration also referred to as a "double-edged blade," in which the first flat portion may extend from a first of the cutting edge portions to a second of the cutting edge portions. Alternatively to the double-edged blade, the blade body may include a base portion connected to the blade element such that the first flat portion is intermediate to the cutting edge portion and the base portion.

The base portion and the first flat portion may be connected to each other by being monolithically constructed with one another, or may be assembled to one another.

The base portion may form a blade support, and may include a second flat portion which may be intermediate the base portion and the cutting edge portion. The second flat portion may extend at an angle with respect to the base portion, so as to be arranged obliquely or perpendicularly thereto. The second flat portion and the base portion may be built together monolithically.

The second flat portion may be connected to the first flat portion such that, during shaving, the second flat portion is arranged towards the skin with respect to the first flat portion. Alternatively, the second flat portion may be connected to the first flat portion such that, during shaving, the first flat portion is arranged towards the skin and the second flat portion faces away from the skin. Alternatively, the first flat portion and the second flat portion may be connected to each other such that the second flat portion prolongs the first flat portion—a configuration also referred to as an integrally-built "bent blade," in which the blade support and the cutting edge portion are monolithically constructed with one another.

When a given skincare device includes multiple blade bodies, two or more of the multiple blade bodies may have an identical configuration to one another, or may have different configurations from one another.

BRIEF DESCRIPTION OF THE DRAWINGS

The disclosure may be more completely understood in consideration of the following detailed description of aspects of the disclosure in connection with the accompanying drawings, in which.

Figure 1A:
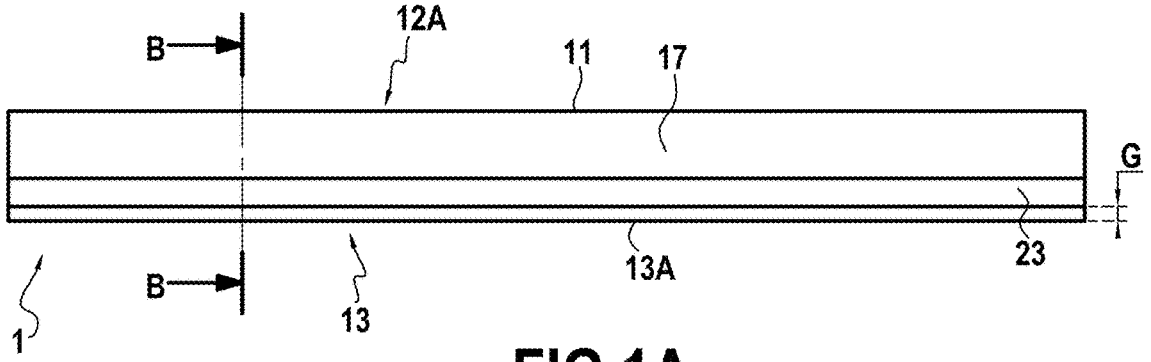
FIG. 1A shows an exemplary razor blade having an exemplary continuous expanded coating structure.

The term "exemplary" is used in the sense of "example," rather than "ideal." While aspects of the disclosure are amenable to various modifications and alternative forms, specifics thereof have been shown by way of example in the drawings and will be described in detail. It should be understood, however, that the intention is not to limit aspects of the disclosure to the particular embodiment(s) described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects and are not intended to limit the scope of the disclosure. The illustrative aspects depicted are intended only as exemplary.

FIG. 1A shows a single-edged razor blade 1 according to an embodiment of the present disclosure, as seen normal or oblique to a top surface 17 of a blade body 11 of the razor blade 1. During shaving with the razor blade 1, the top surface 17 of the blade body 11 is arranged towards the skin. The top surface 17 may be flat.

The blade body 11 of the razor blade 1 presents a first flat portion 12A extending from a cutting edge portion 13. The cutting edge portion 13 presents a cutting edge 13A. The blade body 11 may be metallic (for example stainless steel) with a thickness of approximately equal to or greater than 0.05 mm (millimeter) and equal to or less than 0.1 mm, as measured between opposite surfaces of the first flat portion 12A.

A continuous expanded coating structure 23 is disposed on the blade body 11. The expanded coating structure 23 includes one or more expanded polymer microspheres. The expanded polymer microspheres may include a gas encapsulated within a hollow thermoplastic polymer shell. During shaving, the expanded coating structure 23 and the cutting edge 13A of the cutting edge portion 13 may contact the skin concurrently with one another. Such contact by the expanded coating structure 23 may help to support the skin in a vicinity of the cutting edge 13A of the cutting edge portion 13, leading to improved shaving performance and/or sensation for the user during shaving.

For example, as the expanded coating structure 23 contacts the skin, the skin may become tauter in a vicinity of the cutting edge 13A of the cutting edge portion 13. This may, for example, increase smoothness of contact between the skin and the cutting edge 13A of the cutting edge portion 13.

Additionally or alternatively, for example, the expanded coating structure 23 may allow a portion of the contact force of the razor blade 1 to bypass the cutting edge 13A of the cutting edge portion 13 during transmission to the skin. This may, for example, reduce contact pressure between the skin and the cutting edge 13A of the cutting edge portion 13.

Additionally or alternatively, for example, the expanded coating structure 23 may reduce bulging of the skin towards the blade body 11 in a vicinity of the cutting edge portion 13. This may, for example, allow for a shaver to be perceived on the skin as being less aggressive than a shaver of comparable blade exposure (cutting edge exposure) which lacked expanded coating structures.

Additionally or alternatively, for example, the expanded coating structure 23 may reduce friction between the cutting edge 13A of the cutting edge portion 13 and the skin. This may, for example, facilitate maneuvering of the razor blade 1 on the skin.

Additionally or alternatively, for example, the expanded coating structure 23 may reduce irritation and/or a risk of cutting the skin during shaving.

The expanded coating structure 23 may be provided on the blade body 11 so as to be separated from the cutting edge 13A of the cutting edge portion 13 by a gap G.

Figure 1B:
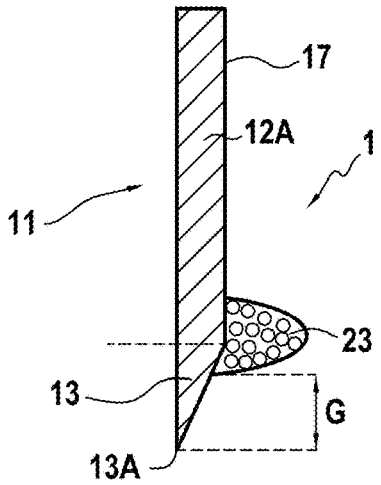
FIG. 1B shows a cross-sectional view of the razor blade of FIG. 1A along line B-B.

FIG. 1B shows the razor blade 1 of FIG. 1A in cross-section along line B-B. The gap G may, for example, be measured as a distance between the expanded coating structure 23 to an orthogonal projection of the cutting edge 13A on a plane in which the top surface 17 of the blade body 11 lies, as measured in the plane from the expanded coating structure to the orthogonal projection. For example, the gap G may measure 1 mm or less. For example, when the blade body 11 has a width, as measured perpendicular to the cutting edge 13A of the cutting edge portion 13 and parallel to the top surface 17 of the blade body 11, of 1.5 mm, the gap G may measure 0.5 mm.

The first flat portion 12A and cutting edge portion 13 are monolithically constructed with one another.

Figure 2A:
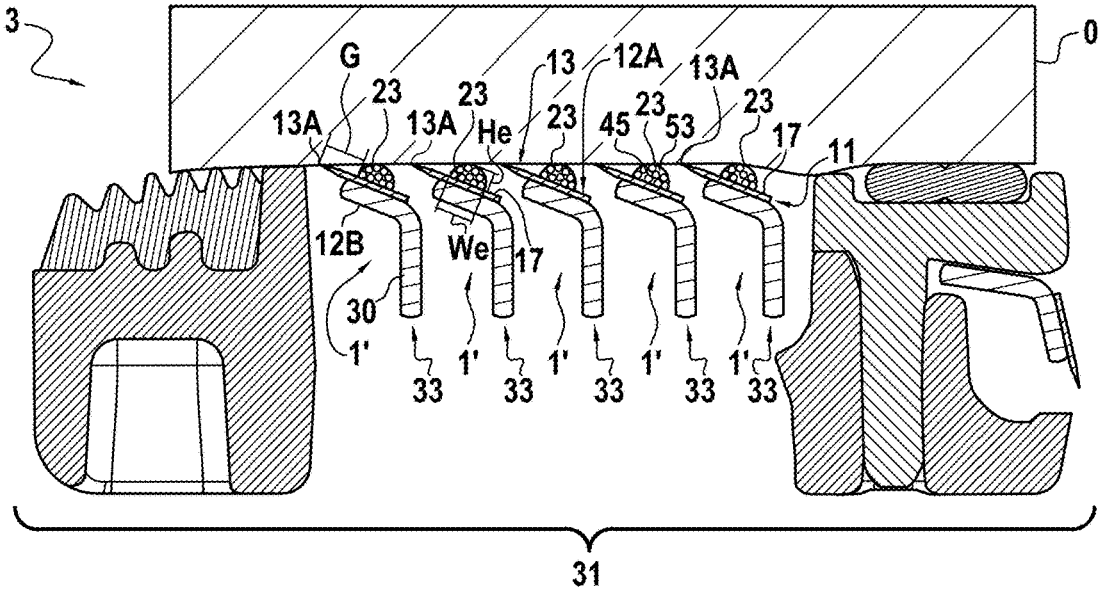
FIG. 2A shows a cross-sectional view of an exemplary shaving cartridge.

FIG. 2A shows a cross-sectional view of a skincare device 3, in particular a shaving cartridge 31, according to an embodiment of the present disclosure, in contact with skin 0 during shaving.

The skincare device 3 may include one or more razor blades, of which at least one may be a razor blade 1' according to an embodiment of the present disclosure. As seen with the razor blade 1 of FIGS. 1A-1B, each such razor blade 1' in FIG. 2A includes a blade body 11 and an expanded coating structure 23 disposed on the cutting edge portion 13 thereof, such that the expanded coating structure 23 and the cutting edge of the cutting edge portion 13 contact the skin 0 concurrently during shaving. The gap G separating the cutting edge 13A of the cutting edge portion 13 from the coating structure 23 may be measured in the same manner as described previously.

In contrast with FIGS. 1A-1B, in each of the razor blades 1' in FIG. 2A, the blade body 11 includes a second flat portion 12B. The first flat portion 12A of the blade body 11 and the second flat portion 12B of the blade body 11 are assembled together. The blade body 11 additionally includes a base portion 30 which extends from the second flat portion 12B such that the second flat portion 12B is intermediate the cutting edge portion 13 and the base portion 30.

The second flat portion 12B and the base portion 30 form a blade support 33, and may be monolithically constructed with one another.

The second flat portion 12B is arranged to extend at an angle, obliquely with respect to the base portion 30, so that the cutting edge 13A of the cutting edge portion 13 (connected thereto via the first flat portion 12A) and the expanded coating structure 23 may be brought to bear on the skin 0 concurrently during shaving.

When the skincare device 3 is maneuvered on the skin 0 of a user during shaving, (during normal intended use of the skincare device 3), the cutting edge(s) 13A of the cutting edge portion(s) 13 of the razor blade(s) 1' contact(s) the skin 0 (possibly in combination with other organic material such as hair) such that the expanded coating structure(s) 23 disposed on the blade body/bodies 11 thereof is/are arranged towards the skin 0 so as to contact the skin 0 as the skin 0 contacts the cutting edge(s) 13A.

The width We of a given expanded coating structure 23 may be measured, for example, along the top surface 17 of the blade body 11, for example parallel to the cutting edge 13A of the cutting edge portion 13 of the razor blade 1', or perpendicular to a projection of the cutting edge 13A of the cutting edge portion 13 to the top surface 17 of the blade body 11 which is orthogonal to the top surface of the blade body 11. The height He of a given expanded coating structure 23 may be measured, for example, normal to the top surface 17 of the blade body 11.

As mentioned above, the expanded coating structure 23 may include one or more expanded polymer microspheres 45, for example. The expanded coating structure 23 may also include a cured polymer matrix 53 in which the expanded polymer microspheres 45 are contained, for example. The expanded polymer microspheres 45 will be discussed in greater detail with regard to FIG. 4A. The expanded coating structure 23 may, for example, include equal to or greater than 0.1% and equal to or less than 30% expanded polymer microspheres 45 by mass, with the cured polymer matrix 53 forming the remainder, or even equal to or greater than 5% and equal to or less than 15% expanded polymer microspheres by mass, with the cured polymer matrix forming the remainder. The expanded coating structure 23 will be discussed in greater detail with regard to FIG. 7.

Figure 2B:
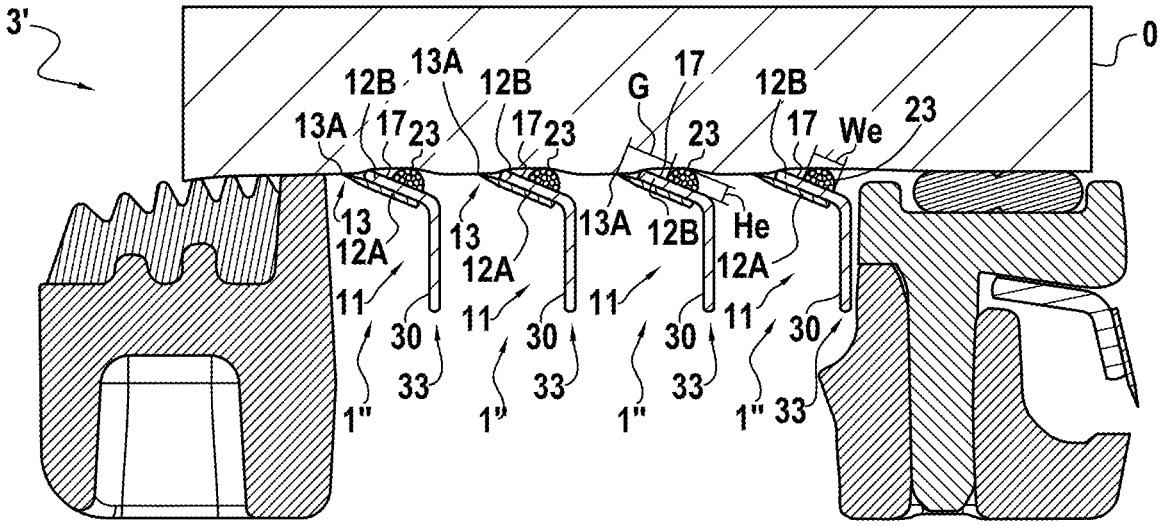
FIG. 2B shows a cross-sectional view of an exemplary shaving cartridge.

FIG. 2B shows a cross-sectional view of a shaving cartridge 3', similar to the cartridge 3 shown in FIG. 2A. In contrast with the cartridge 3 shown in FIG. 2A, which includes five exemplary razor blades 1', the cartridge 3' shown in FIG. 2B includes four exemplary razor blades 1".

In contrast with the exemplary razor blades 1' shown in FIG. 2A, in which the cutting edge portion 13 and the first flat portion 12A of the blade body 11 separates the skin 0 from the blade support 33, each of the exemplary razor blades 1" shown in FIG. 2B has a blade body 11 of which the cutting edge portion 13 and the first flat portion 12A are mounted on a blade support 33 such that the blade support 33 is arranged towards the skin 0 with respect to the cutting edge portion 13 and first flat portion 12A during shaving. As with FIG. 2A, the blade support 33 includes a base portion 30 of the blade body 11 and a second flat portion 12B of the blade body 11 arranged intermediate the cutting edge portion 13 and the base portion 30.

In contrast with FIG. 2A, in which the top surface 17 is presented on the cutting edge portion 13 and/or on the first flat portion 12A, in FIG. 2B, the top surface 17 of the blade body 11 is presented on the second flat portion 12B of the blade body 11. The expanded coating structure 23 is therefore provided on the blade support 33, and the width We of the expanded coating structure 23, thickness He of the expanded coating structure 23 and gap G separating the expanded coating structure from the cutting edge are measured as described previously, albeit using the top surface 17 as presented by the second flat portion 12B of the blade support 33.

As with FIG. 2A, in FIG. 2B, the second flat portion 12B is angled obliquely with respect to the base portion 30 such that the cutting edge 13A of the cutting edge portion 13 and the expanded coating structure 23 can be brought to bear concurrently with one another on the skin 0 during shaving. Additionally, as an option visible in FIG. 2B, the second flat portion 12B of the blade body 11 may be brought to bear on the skin 0 during shaving. When multiple razor blades according to the present disclosure are provided to a skincare device, it may be understood that two or more razor blades may be provided according to the same embodiment of the present disclosure and/or that two or more razor blades may be provided according to different embodiments of the present disclosure.

Figure 3:
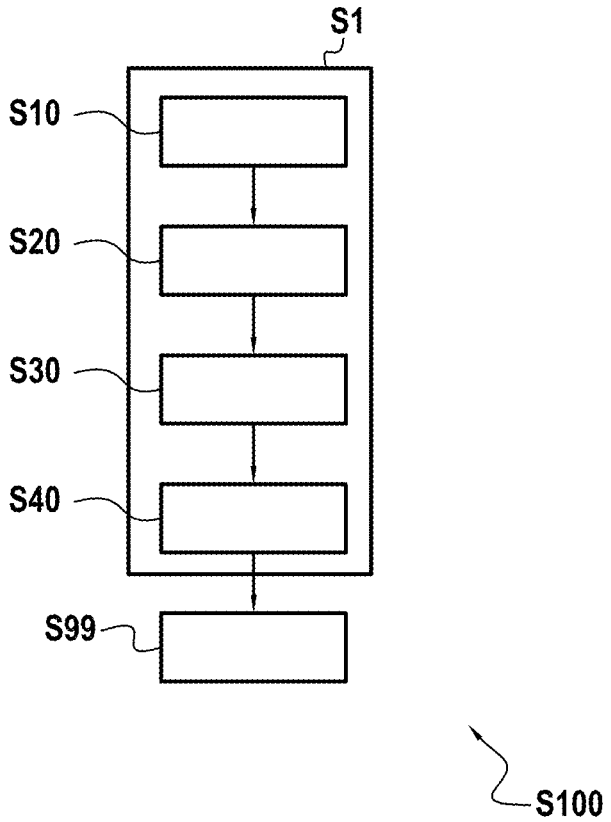
FIG. 3 shows a process flow chart for an exemplary process for fabricating a skincare device.

FIG. 3 shows a process S100 by which a skincare device, such as the skincare device 3 shown in FIG. 2A or the skincare device 3' shown in FIG. 2B, may be fabricated. The process S100 for fabricating a skincare device may include providing a razor blade according to an embodiment of the present disclosure and arranging S99 the base portion of blade body of the razor blade within a razor cartridge. Arranging S99 the base portion of the blade body of the razor blade within the cartridge may be performed in a conventional manner, for example by providing the cartridge with one or more slots and arranging the base portion(s) of the corresponding blade body/ies within the slot(s).

As will be discussed in greater detail with regard to FIG. 9, the cutting edge portion of the blade body may alternatively be monolithically constructed with the blade support, rather than assembled together as described earlier herein. For example, the second flat portion may be made to extend monolithically from the first flat portion away from the cutting edge of the cutting edge portion. In this case, the top surface of the blade body may be presented by both the first flat portion and the second flat portion.

When the blade support and the cutting edge portion are monolithically constructed with one another, the step of attaching S99 the cutting edge portion to the razor cartridge may be performed simultaneously with attaching the blade support to the cartridge. When the blade support and the cutting edge portion are not monolithically constructed with one another, the step of attaching S99 the cutting edge portion to the cartridge may be performed simultaneously with attaching the blade support to the razor cartridge (for example by attaching the blade support to the razor cartridge subsequent to assembling the cutting edge portion to the blade support), or may be performed sequentially with attaching the blade support to the razor cartridge (for example by assembling the cutting edge portion to the blade support subsequent to attaching the blade support to the razor cartridge).

As a non-limiting example, the razor blade may be provided by performing a process S1 of fabricating a razor blade. The process S1 for fabricating a razor blade may include providing S10 a blade body, followed by depositing S20 a liquid suspension on a surface of the blade body to obtain a deposit containing one or more expandable polymer microspheres, followed by expanding S30 one or more of the expandable polymer microspheres dispersed in the deposit to obtain an expanded deposit containing one or more expanded polymer microspheres. The liquid deposit may be provided as a liquid suspension of expandable polymer microspheres dispersed in a liquid uncured polymer precursor, which may be configured to remain uncured during expansion of the expandable polymer microspheres. The process S1 may also include a step of curing S40 the liquid uncured polymer precursor, subsequent to expanding S30 the one or more expandable polymer microspheres, to obtain a cured polymer matrix in which the expanded polymer microspheres are contained.

Figure 4A:
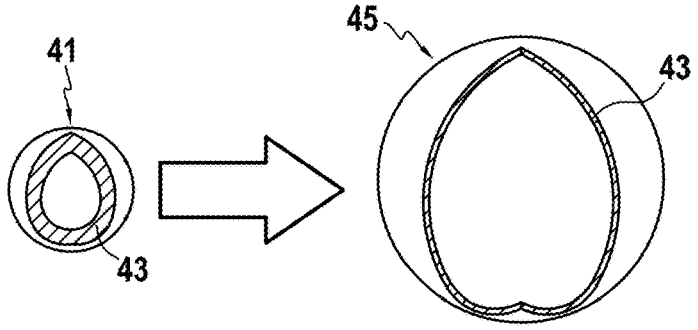
FIG. 4A shows a cutaway view of an exemplary microsphere in both an unexpanded state (left) and expanded state (right).

FIG. 4A shows an exemplary polymer microsphere. The polymer microsphere may be configured to expand when heated due to internal pressure of a gas enclosed therein. For example, the microsphere may have a size (for example a diameter), prior to expansion, of equal to or greater than 5 μm and equal to or less than 40 μm, or even equal to or greater than 6 μm and equal to or less than 40 μm, or even equal to or greater than 6 μm and equal to or less than 9 μm. The microsphere is shown prior to expansion at 41 and is shown in an expanded state at 45. Accordingly, prior to expansion, the microsphere is referred to as "expandable", and is referred to as "expanded" subsequent to expansion. One example of an expandable microsphere 41 is sold under the name "Expancel" by Nouryon.

The microsphere may be substantially hollow, for example, and may include a shell 43 made of thermoplastic polymer to enclose the gas. Prior to expansion, the shell 43 may, for example, have a thickness of approximately 2 μm. Subsequent to expansion, the shell 43 may, for example, have a thickness of less than 2 μm.

Heating the microsphere may allow for internal pressure within the microsphere to deform the shell 43 plastically. Accordingly, expanding the expandable polymer microsphere may include heating the expandable polymer microsphere to a temperature at which the shell is plastically deformable from the internal pressure within the expandable polymer microsphere.

During heating, the expandable polymer microsphere may reach a temperature, for example, of equal to or greater than 80° C. and equal to or less than 200° C., or equal to or greater than 100° C. and equal to or less than 150° C., or equal to or greater than 80° C. and equal to or less than 135° C. Heating will be discussed in greater detail with regard to FIG. 5.

While expanding S30, at least one expandable polymer microsphere may undergo, for example, an increase in volume equal to or less than 200-fold, or a 38-fold increase in volume, as it becomes an expanded polymer microsphere.

Figure 4B:
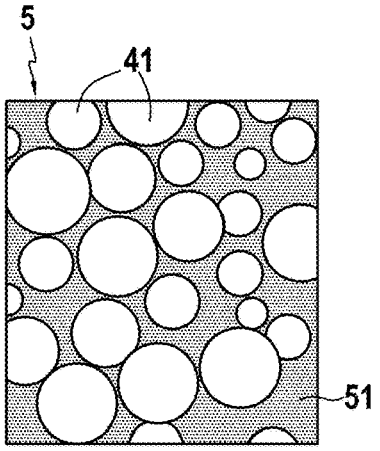
FIG. 4B shows an exemplary liquid suspension.

FIG. 4B shows a schematic representation of an exemplary liquid suspension 5. As an example, the liquid suspension 5 may be for coating at least a portion of a blade body.

The liquid suspension 5 includes a liquid uncured polymer precursor 51 and expandable polymer microspheres 41. At least one of the expandable polymer microspheres 41 of the liquid suspension 5 may be an expandable polymer microsphere 41 as described earlier herein, for example.

As an example, the liquid suspension 5 may include equal to or greater than 0.1% and equal to or less than 30% expandable polymer microspheres 41 by mass, or even equal to or greater than 5% and equal to or less than 15% expandable polymer microspheres 41 by mass. The liquid uncured polymer precursor 51 may form the remainder of the liquid suspension 5.

As an example, the liquid suspension 5 may be manufactured by mixing the liquid uncured polymer precursor 51 and expandable polymer microspheres 41 together.

The liquid uncured polymer precursor 51 may be UV-curable, and may even include a UV-curing initiator, for example. Non-limiting examples of such liquid uncured polymer precursors include 758-series "Solarez" UV-cure products offered by Wahoo International.

Thermal-curable and/or infrared-curable liquid uncured polymer precursors are also contemplated, as are liquid uncured polymer precursors which cure through atmospheric exposure, for example.

The liquid uncured polymer precursor 51 may include cyanoacrylate, acrylated epoxy, acrylated polyester, acrylated silicon, or methacrylate ester, for example.

The liquid uncured polymer precursor 51 may, for example, be configured to remain at least partially uncured when heated to the temperatures at which the microspheres are heated to transform them from expandable polymer microspheres 41 to expanded polymer microspheres (for example during heating) for a duration sufficient for such transformation of the microspheres to occur. For example, expansion of the expandable microspheres within a given deposit may occur over a period of 20 ms (millliseconds) or less, whereas complete curing of the liquid uncured polymer precursor in the given deposit may occur over a period of approximately one second or more. Additionally or alternatively, curing of the liquid uncured polymer precursor may be triggered at higher energy levels and/or temperatures than are necessary for causing expansion of the expandable microspheres.

As seen in FIG. 3, the process S1 for fabricating the razor blade may also include curing S40 the expanded deposit thereby forming an expanded coating structure including a cured polymer matrix containing one or more expanded microspheres. Curing S40 may allow at least a portion of the uncured liquid polymer precursor, contained in the liquid suspension previously deposited onto the blade body and present in the expanded coating structure after expanding S30, to be transformed into a cured polymer matrix containing the one or more expanded microspheres, for example. Although complete curing of the liquid uncured polymer precursor may prevent or interfere with subsequent expansion of microspheres contained in the resulting cured polymer matrix, the term "expandable polymer microsphere" is still used to refer to microspheres which, prior to curing, could have been made to expand, thereby transforming into expanded polymer microspheres.

When the liquid uncured polymer precursor of the liquid suspension is UV-curable, curing S40 may include exposing the liquid uncured polymer precursor (or UV-curable initiator thereof, when present) to ultraviolet or near-ultraviolet electromagnetic radiation. As an embodiment, the electromagnetic radiation used during curing S40 may have a wavelength of 405 nm or less. This may allow depositing S20 and expanding S30 to be conducted in visible light prior to curing S40, for example. As an embodiment, the electromagnetic radiation used in curing the liquid uncured polymer precursor may be provided by a light-emitting diode and/or a laser.

When the liquid uncured polymer precursor of the liquid suspension contains cyanoacrylate, curing S40 may include exposing the cyanoacrylate to moisture.

The expandable polymer microspheres provided during depositing S20 may allow for formation of the expanded coating structure to be at least partially dissociated from deposition of its/their constituent materials. This may, for example, allow for reductions in fabrication cost and/or time and/or complexity for the razor blade. For example, depositing S20 a relatively thin deposit and expanding S30 the expandable polymer microspheres therein to obtain an expanded coating structure of a desired thickness may be cheaper/simpler/faster than forming a deposit whose thickness is nearer to that of the desired protrusion thickness without expansion. For example, depositing S20 a relatively uniform deposit on the blade body and providing local variations in expansion during expanding S30 to obtain a desired expanded coating structure pattern/geometry may be simpler/more precise than depositing a relatively non-uniform deposit to obtain the desired protrusion pattern/geometry without expansion. Either or both of these may also translate to reductions in cost, for example. These benefits may be seen even when the process S1 for fabricating the razor blade includes curing S40.

Figure 5:
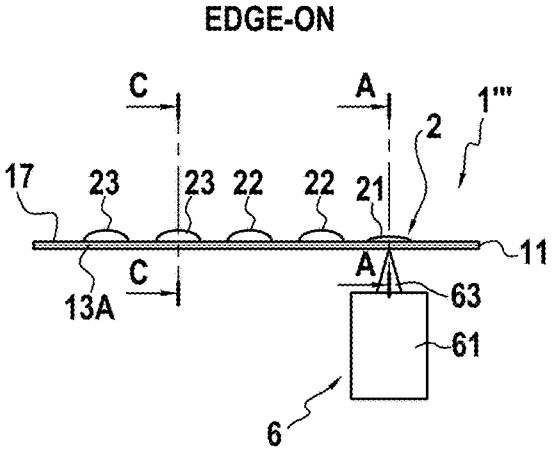
FIG. 5 shows an exemplary step of an exemplary process for fabricating a razor blade.

FIG. 5 shows a schematic view of an exemplary razor blade 1''' according to an embodiment of the present disclosure during expanding by heating.

In contrast with the razor blade 1 shown in FIG. 1A, the razor blade 1''' shown being fabricated in FIG. 5 includes a double-edged blade body 11 (such as those available for so-called "safety" shavers). The razor blade 1''' is shown "edge-on" relative to a cutting edge of a first cutting edge portion 13 of the blade body 11. The first cutting edge portion of the blade body 11 is connected to a second cutting edge portion of the blade body 11 by way of a first flat portion extending therebetween which is monolithically constructed with the first and second cutting edge portions. Each cutting edge portion of the blade body includes its own cutting edge 13A.

In contrast with the razor blade 1 shown in FIG. 1A, the razor blade 1''' shown being fabricated in FIG. 5 will include multiple discrete expanded coating structures. Accordingly, the liquid suspension has been provided as multiple discrete deposits, 2, 22. Expansion has been performed sequentially from the left side of FIG. 5 to the right side of FIG. 5. On the right side of FIG. 5, at formation site 21, an unexpanded deposit 2 is shown prior to expanding and transforming into an expanded deposit. Multiple discrete expanded deposits 22 are shown to the left of the formation site 21, near the center of FIG. 5.

The expanded deposits 22 will be transformed into expanded coating structures 23 when the liquid uncured polymer precursor contained therein is cured to form a cured polymer matrix.

On the left side of FIG. 5, multiple discrete expanded coating structures 23 are shown, subsequent to curing of the liquid uncured polymer precursor to form a cured polymer matrix.

The geometry and/or quantity of expanded coating structures 23 on a given razor blade 1''' may be determined during deposition of the unexpanded deposit(s) 2, and/or during expansion of the expandable polymer microspheres, for example. This possibility will be discussed in greater detail later.

A heating device 6 may be provided, which is configured to provide energy to heat the deposit(s) 2 on the blade body 11 to form the expanded polymer microspheres of the expanded coating structure 23. The heating device 6 may, for example, include a heating element configured to be arranged in close proximity to the unexpanded deposit(s) 2. For example, the heating element may be made to contact the blade body 11 and/or unexpanded deposit 2 so as to conduct heat thereto. Additionally or alternatively, as seen in FIG. 5, the heating device 6 may include an electromagnetic radiation source 61, for example. The electromagnetic radiation source 61 may emit a beam 63 of electromagnetic radiation to heat the expandable polymer microspheres, for example. The beam 63 may include infrared radiation, for example. The electromagnetic radiation source 61 may, for example, include a laser. This heating device may be used in all embodiments disclosed herein. Although radiative heating is described, convective and conductive heating are also contemplated.

The heating device 6 may be provided to heat the unexpanded deposit 2 directly (for example by exposing the unexpanded deposit to the beam 63, when present) and/or indirectly (for example by exposing the blade body 11 to the beam 63, when present, so as to transfer heat into the unexpanded deposit).

As a non-limiting example, indirect heating may allow for heating to be provided at a higher intensity than may be suitable for generating the expanded polymer microspheres of the expanded coating structure. Additionally or alternatively, for example, this may allow heat transfer characteristics of the substrate of the unexpanded deposit 2 (for example the blade body 11) to contribute to controlling formation of the expanded polymer microspheres and/or the geometry of the resulting expanded coating structure(s).

When heating the unexpanded deposit 2 indirectly, heat may be delivered to a different side of the blade body 11 from the unexpanded deposit 2. For example in FIG. 5, the beam 63 is focused onto an opposite surface of the blade body 11 from the unexpanded deposit 2. For example, since the unexpanded deposit 2 in FIG. 5 is provided on a top surface 17 of the blade body 11, the beam 63 is directed onto the bottom surface of the blade body 11. Heat may be transferred into the unexpanded deposit 2 at the formation site 21, opposite from the beam 63, from the side of the unexpanded deposit's substrate (in this case the side of the unexpanded deposit 2 that is nearest the blade body 11).

Figure 6:
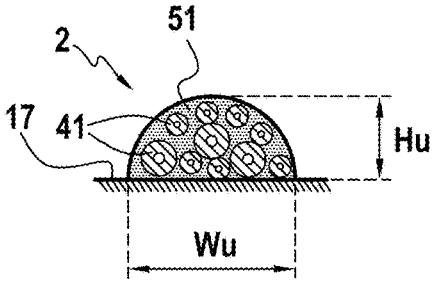
FIG. 6 shows a cross-sectional view of an exemplary deposit as seen along line A-A of FIG. 5.

FIG. 6 shows a cross section of an exemplary unexpanded deposit 2. The unexpanded deposit 2 may be, for example, the unexpanded deposit 2 provided at the formation site 21 in FIG. 5.

As an embodiment, the unexpanded deposit 2 may have a maximum thickness Hu of equal to or greater than 20 μm and equal to or less than 200 μm, as measured normal to the blade body (for example normal to the top surface 17 of the blade body).

Additionally or alternatively, the unexpanded deposit 2 may have a width Wu of equal to or greater than 100 μm and equal to or less than 850 μm, as measured parallel to the top surface 17 of the blade body (for example along the length of the blade body, parallel to the cutting edge, and/or along the width of the blade body, parallel to the top surface 17 of the blade body and perpendicular to the cutting edge).

Although the unexpanded deposit 2 is shown as being substantially semicircular in profile, it is also contemplated to provide a deposit that is substantially flat in profile.

The mass fractions of expandable polymer microspheres 41 and liquid uncured polymer precursor 51 of the unexpanded deposit 2 may correspond substantially to those of the liquid suspension provided during depositing S20 in FIG. 3.

Figure 7:
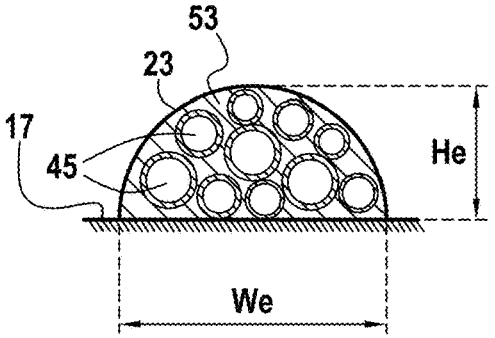
FIG. 7 shows a cross-sectional view of an exemplary expanded coating structure as seen along line C-C of FIG. 5.

FIG. 7 shows an exemplary expanded coating structure 23 obtainable from the unexpanded deposit 2 of FIG. 6 after expansion of the expandable polymer microspheres 41 therein to create expanded polymer microspheres 45 (and curing of liquid uncured polymer precursor 51 of the resulting expanded protrusion, when required). The expanded polymer microspheres 45 may be contained in a cured polymer matrix 53 obtainable by curing the liquid uncured polymer precursor 51 provided in the unexpanded deposit 2 of FIG. 6. Although the mass fractions of expanded polymer microspheres 45 and cured polymer matrix 53 in the expanded coating structure 23 may correspond to the mass fractions of expandable polymer microspheres 41 and liquid uncured polymer precursor 51 in the unexpanded deposit 2, it may be understood (and it is contemplated) to provide an expanded coating structure which contains a mixture of expandable and expanded microspheres, for example by avoiding heating of a given region of the deposit prior to expansion of all of the expandable microspheres located therein.

As an embodiment, expansion of the expandable polymer microspheres may cause the expanded coating structure 23 to have a maximum thickness He of equal to or greater than 100 μm and equal to or less than 500 μm, or even equal to or greater than 120 μm and equal to or less than 300 μm.

Additionally or alternatively, the expanded coating structure 23 may have a width We, of equal to or greater than 100 μm and equal to or less than 2000 μm, or even equal to or greater than 550 μm and equal to or less than 1000 μm, for example. Although the resulting expanded coating structure 23 is shown as having a profile that is substantially similar in shape to that of the corresponding unexpanded deposit 2 from which it was obtained, it is understood that an expanded coating structure may be provided with a substantially different profile to the corresponding unexpanded deposit, for example by providing variations in heating. Although the expanded coating structure 23 is shown as being its widest at its interface with the top surface 17 of the blade body, it may be understood that, depending on how expanding S30 progresses, the maximum width We may occur at a distance from the top surface 17.

As indicated earlier, the geometry and/or quantity of expanded coating structures 23 on a given razor blade may additionally or alternatively be determined during deposition of the deposit 2, for example. Returning now to FIG. 3, for example, during depositing S20, the liquid suspension may be deposited multiple distinct locations on the blade body, so that formation of the expanded coating structures by expanding S30 the expandable microsphere(s) may be substantially constrained to these locations. For example, so-called "inkjet technology" (in which a jet of material which may or may not be ink is projected onto a target material) may be used to deliver the liquid suspension to the desired location(s) on the blade body during depositing S20. It is also contemplated to make use of other "printing-type" techniques during depositing S20, possibly in combination with the inkjet technology technique described above. For example, pad printing or roller printing may be suitable for depositing S20 the liquid suspension onto the blade body. It is also contemplated to make use of a liquid dispenser, such as the "752V" or "PICO Pμlse" dispensers offered by Nordson, for depositing S20 the liquid suspension onto the blade body.

The placement (on the blade body) and/or geometry of the deposit formed by depositing S20 may help to determine the placement and/or geometry of the expanded coating structure that may be obtainable by expanding S30. For example, the interface between the expanded coating structure and the blade body may correspond substantially to the geometry of the interface between the blade body and the deposit from which the expanded coating structure was formed.

Figure 8:
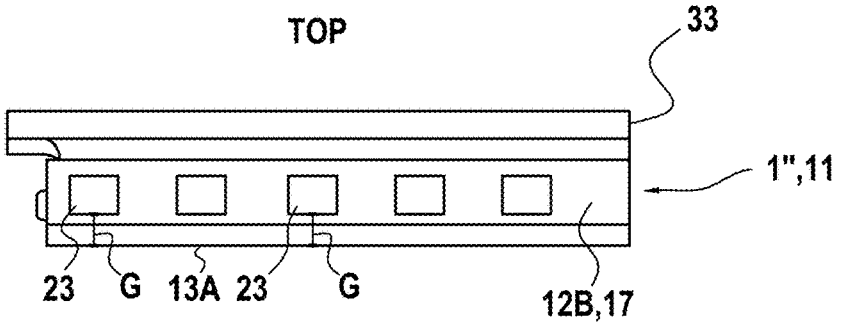
FIG. 8 shows a top view of an exemplary razor blade having discrete expanded coating structures.

FIG. 8, for example, shows a top view of one of the razor blades 1" of FIG. 2B (normal to the top surface 17 of the blade body 11), subsequent to depositing S20, expanding S30, and curing S40.

Depositing S20 was performed onto the blade support 33 presenting the top surface 17 of the blade body 11, yielding multiple discrete unexpanded deposits, as seen with FIG. 5. It may be understood, however, that a single, continuous unexpanded deposit may also be suitable for this razor blade 1".

In contrast with FIG. 5, however, expanding S30 for this razor blade 1" was performed by arranging for direct heating of the unexpanded deposits, however it may be understood that indirect heating may also be suitable for this razor blade 1".

Although the razor blade 1" is shown subsequent to assembly of the cutting edge portion 13 to the blade support, it may be understood that such assembly may be performed subsequent to depositing S20, expanding S30 and curing S40.

The razor blade 1" in FIG. 8 is shown as having multiple discrete expanded coating structures 23, which each have substantially rectangular "footprints" (areas of contact with the blade body 11) as a result of them being formed from deposits that were substantially rectangular in shape on the blade body 11. Non-rectangular footprints are also contemplated. By providing a plurality of discrete deposits which are distinct from one another on the blade body 11, it may be possible to obtain a plurality of discrete expanded coating structures 23 which are distinct from one another even if heating (when used during expanding) would be performed over a larger area than merely where expanded coating structures are desired, for example.

Figure 9:
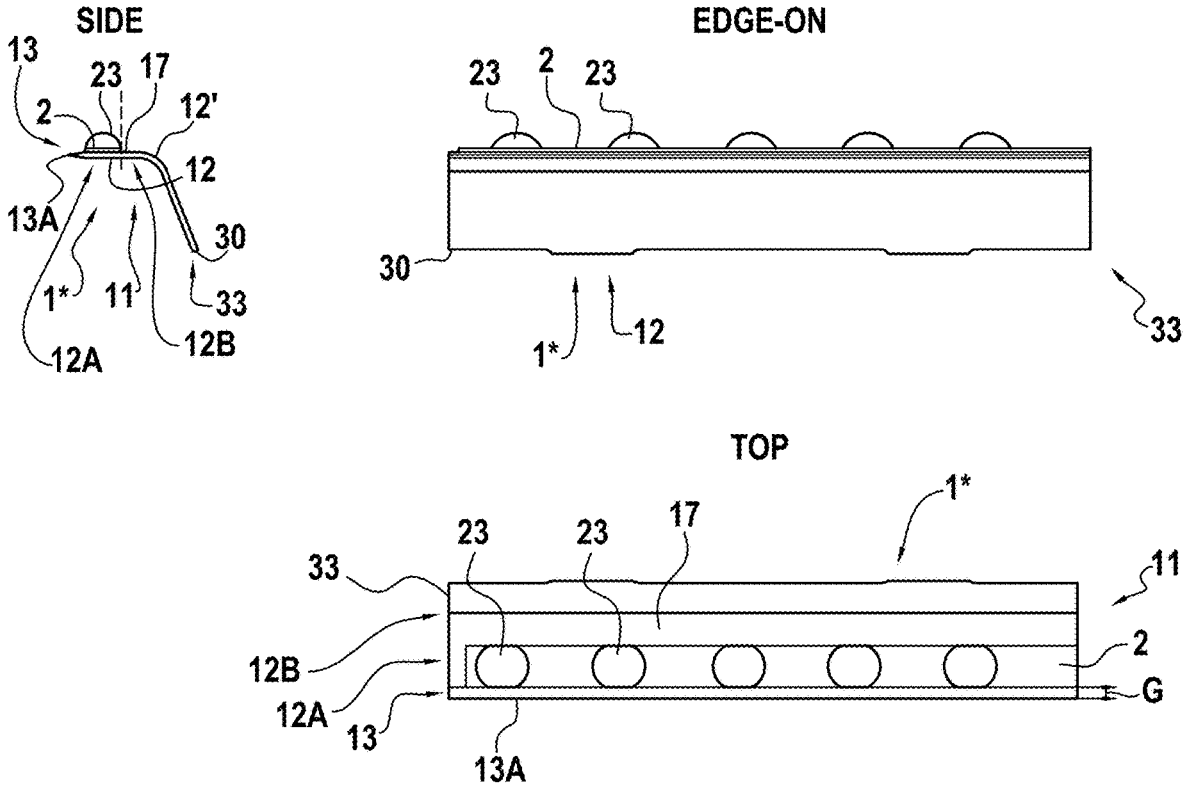
FIG. 9 shows an exemplary razor blade having multiple expanded coating structures, including a side view, an edge-on view, and a top view.

FIG. 9 shows a top view, edge-on view, and side view (orthogonal to the top and edge-on views) of a razor blade 1* as a one-piece blade body, called a "bent blade". In contrast with the razor blades 1', 1" shown in FIGS. 2A & 2B, the razor blade 1* shown in FIG. 9 has a cutting edge portion 13 which is monolithically constructed with a blade support 33. The first flat portion 12A extends from the cutting edge portion 13 as seen in FIG. 1A, but is prolonged by a second flat portion 12B extending from an intermediate portion 12' linking the second flat portion 12B to the base portion 30. The base portion 30, the second flat portion 12B and the intermediate portion 12' form the blade support 33, which is monolithic with the cutting edge portion 13 and the first flat portion 12A. In contrast with the razor blade 1" shown in FIG. 8, the razor blade 1* shown in FIG. 9 includes a plurality of expanded coating structures 23 obtained by selectively expanding non-contiguous regions of a shared unexpanded deposit 2. Accordingly, the remnants of the unexpanded deposit 2 are shown in FIG. 9 as extending between adjacent expanded coating structures 23. By forming multiple expanded coating structures 23 from a shared unexpanded deposit 2, it may be possible to reduce the time required to perform depositing of the liquid suspension on the blade body 11, for example. Additionally or alternatively, for example, unexpanded regions of a shared deposit 2 from which multiple expanded coating structure(s) 23 may contribute to the strength of the connections between these expanded coating structures and the blade body 11.

Although the expanded coating structures 23 in FIGS. 8 & 9 are shown as having substantially equivalent gaps G with respect to the cutting edge 13 as each other, it is also contemplated for multiple expanded coating structures 23 within a given plurality of expanded coating structures to have different gaps G from one another. Likewise, as seen in FIG. 10, the gap G may vary along the length of the blade body 11 even when a continuous expanded coating structure 23 is provided.

Figure 10:
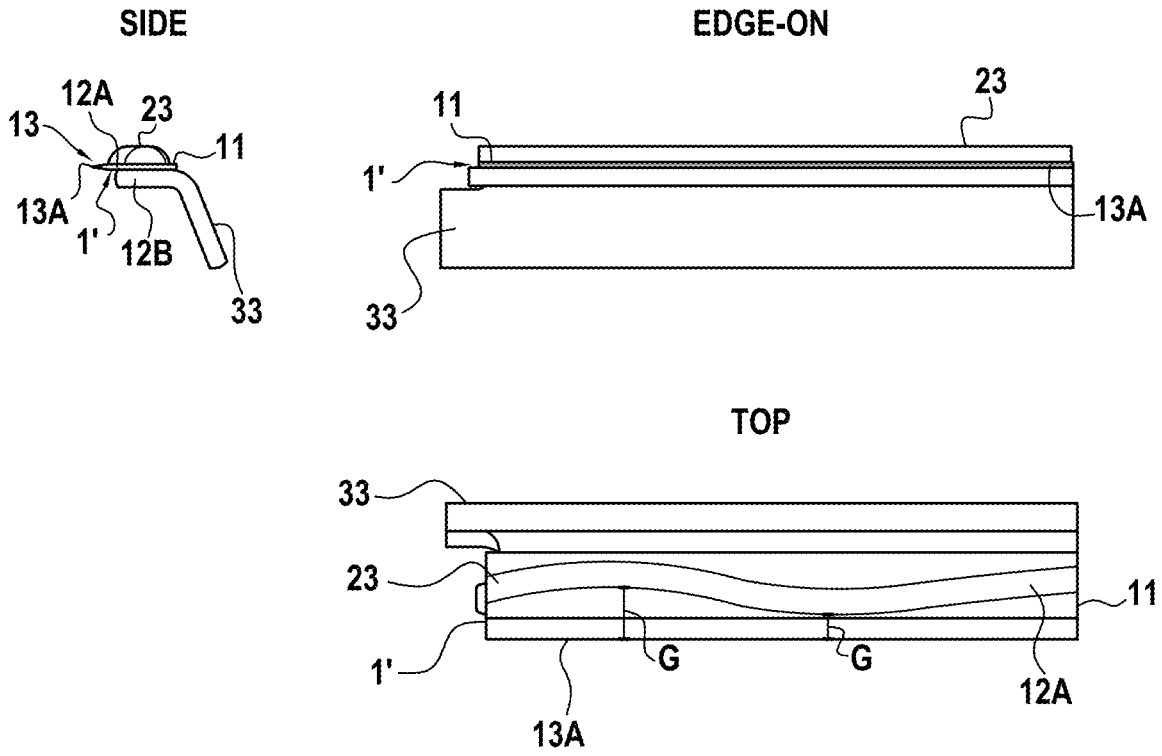
FIG. 10 shows an exemplary razor blade having a continuous expanded coating structure in curvilinear shape, including a side view, an edge-on view, and a top view.

FIG. 10 shows one of the razor blades 1' of FIG. 2A, and includes top, side, and edge-on views as seen in FIG. 9. In contrast with the razor blade 1* shown in FIG. 9, the razor blade 1' shown in FIG. 10 includes a curvilinear expanded coating structure 23 obtained by uniformly expanding a continuous curvilinear deposit arranged along the cutting edge portion 13 of the blade body 11, and the cutting edge portion 13 is mounted to a blade support 33. The gap G separating the expanded coating structure 23 from the cutting edge of the cutting edge portion 13 is seen to vary along the length direction of the blade body 11 (parallel to the cutting edge).

It may be understood that any of the foregoing deposition and/or expanded coating geometries may be suitable for use with any of the foregoing blade body configurations.

A first non-limiting example will now be described.

Expancel 461 DU 20 expandable polymer microspheres (D50=6-9 μm according to product data sheet) were dispersed in a liquid uncured polymer precursor (Solarez 75800 UV-Cure Epoxy Resin, monomer content=35%) to obtain a first liquid suspension containing 6-12% expandable polymer microspheres by mass and liquid uncured polymer precursor forming the remainder.

A cutting edge portion of a double-edged blade body was provided, measuring 0.1 mm thick, and made of stainless steel.

Pad printing was used for depositing the first liquid suspension onto a top surface of the cutting edge portion of the blade body such that a continuous linear deposit was arranged substantially parallel to the cutting edge of the blade body. The deposit was observed to have a width of 650-850 μm as measured parallel to the top surface of the blade body, and had a thickness of 20-200 μm as measured perpendicular to the top surface of the blade body.

An 80 watt beam of infrared light was used for expanding the expandable microspheres of the deposits. The beam had a wavelength of 1064 nm and was shone onto blade body from an infrared laser at a plurality of locations on the bottom surface thereof. Each location illuminated by the beam was circular with a diameter of 0.6 mm, and centered on the opposite side of the blade body from a deposit in the first plurality of deposits. Each location was illuminated for 5 ms (milliseconds), causing heating of the blade body and of the corresponding deposit until expandable microspheres of the exposed portion of the deposit reached the prescribed expansion temperature range indicated on the product datasheet (approximately 106-137° C.).

The resulting expanded deposits, corresponding to the portions of the unexpanded deposit subjected to expansion, had a substantially semi-circular cross-section with a diameter of 550-1000 μm and a thickness of 120-300 μm.

Digital microscopic analysis of a sample of 30 expanded polymer microspheres in these expanded coating structures revealed diameters in the range of 10-21 μm as measured using standard microscopy techniques, corresponding to these microspheres increasing in volume 13-43 fold while expanding from expandable polymer microspheres to expanded polymer microspheres.

A second non-limiting example will now be described.

A razor blade was prepared as described in the first non-limiting example, and the expanded coating structures thereof were subjected to curing by exposure to a 0.5-watt beam from a light-emitting diode configured to emit near ultraviolet radiation at a wavelength of 405 nm.

Exposure to the beam lasted 5 seconds, causing transformation of the liquid uncured polymer precursor remaining from the deposits from which the expanded coating structures were formed into a cured polymer matrix, as confirmed by digital microscopic analysis of 4 protrusions of the expanded coating structure subsequent to curing in this manner.

A third non-limiting example will now be described.

A liquid suspension was created as described in the first non-limiting example, but using Expancel 031 DU 40 expandable polymer microspheres (D50=10-16 μm according to product data sheet) instead of 461 DU 20 microspheres.

A cutting edge portion of blade body was provided as described in the first non-limiting example, and the liquid suspension was deposited onto the top surface of the cutting edge portion of the blade body in the same manner as described with regard to the first non-limiting example. The deposit had similar dimensions to those of the first non-limiting example.

The blade body and associated unexpanded deposit were heated in an oven until expandable microspheres of the deposit reached the prescribed temperature range indicated on the product datasheet (approximately 95-120° C.) to transform the unexpanded deposit into an expanded deposit. The resulting expanded deposit was then cured as described with respect to the second non-limiting example to yield an expanded coating structure.

Although the described embodiments were provided as different exemplary embodiments, it is envisioned that these embodiments are combinable or, when not conflicting, the features recited in the described embodiments may be interchangeable. Moreover, the features recited in the described embodiments are not inextricably linked to one another, unless such a linkage is clearly indicated between two given features.

Throughout the description, including the claims, the term "comprising a" should be understood as being synonymous with "comprising at least one" unless otherwise stated. In addition, any range set forth herein, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A process for fabrication of a razor blade, wherein the process comprises:

providing a blade body;

depositing a liquid suspension on a surface of the blade body, the liquid suspension comprising expandable polymer microspheres dispersed in a liquid uncured polymer precursor, each expandable polymer microsphere including a gas encapsulated within a hollow thermoplastic polymer shell, to obtain a deposit of the liquid suspension on the surface;

heating the deposited liquid suspension to expand one or more polymer microspheres arranged in the liquid suspension on the surface of the blade body, wherein the liquid uncured polymer precursor remains at least partially uncured when the deposited liquid suspension heated to the temperatures at which the microspheres are transformed from expandable polymer microspheres to expanded polymer microspheres.

2. The process of claim 1, wherein the mass of the liquid suspension comprises between 0.1% and 30% of the expandable polymer microspheres by mass, with the liquid uncured polymer precursor forming the remainder.

3. The process of claim 1, wherein at least one of the expandable polymer microspheres has a diameter equal to or greater than 5 μm and equal to or less than 40 μm prior to expansion.

4. The process of claim 1, wherein the liquid uncured polymer precursor is UV-curable.

5. The process of claim 1, wherein the heating the one or more expandable polymer microspheres to a temperature at which the shell is plastically deformable under pressure of the gas encapsulated therein.

6. The process (S1) of claim 1, wherein the heating the one or more expandable polymer microspheres comprises heating to a temperature equal to or greater than 80° C. and equal to or less than 200° C.

7. The process of claim 1, further comprising curing at least a portion of the liquid uncured polymer precursor subsequent to the step of expanding at least a portion of the expandable polymer microspheres to obtain a polymer matrix containing one or more expanded polymer microspheres.

8. The process of claim 7, wherein the curing is performed using UV radiation.

9. A skincare device comprising: the razor blade fabricated according to the process of claim 1.

* * * * *